US007097001B2

(12) United States Patent
Martin

(10) Patent No.: US 7,097,001 B2
(45) Date of Patent: Aug. 29, 2006

(54) ELEVATOR CAR DOOR MOVEMENT RESTRICTOR

(75) Inventor: Matthew Martin, Randolph, NJ (US)

(73) Assignee: Inventio AG, Hergiswil (CH)

( * ) Notice: Subject to any disclaimer, the term of this patent is extended or adjusted under 35 U.S.C. 154(b) by 377 days.

(21) Appl. No.: 10/706,783

(22) Filed: Nov. 12, 2003

(65) Prior Publication Data

US 2005/0098389 A1 May 12, 2005

(51) Int. Cl.
*B66B 13/14* (2006.01)

(52) U.S. Cl. ..... 187/316; 187/290; 187/391

(58) Field of Classification Search ..... 187/313, 187/316, 317, 282, 283, 288, 290, 391, 393, 187/394, 250; 307/64, 66
See application file for complete search history.

(56) References Cited

U.S. PATENT DOCUMENTS 3,706,357 A * 12/1972 Simpson ..... 187/290
4,376,471 A * 3/1983 Uchino et al. ..... 187/290
4,529,065 A * 7/1985 Kraft ..... 187/314
5,655,627 A 8/1997 Horne et al.
5,693,919 A * 12/1997 Sager et al. ..... 187/282
5,894,911 A 4/1999 Bozorgzadeh et al.
5,918,705 A 7/1999 Friend
6,269,910 B1 * 8/2001 Fargo et al. ..... 187/287

FOREIGN PATENT DOCUMENTS

GB 2 256 100 11/1992
JP 04182287 A * 6/1992
JP 04277182 A * 10/1992
JP 10167638 6/1998

* cited by examiner

*Primary Examiner*—Jonathan Salata
(74) *Attorney, Agent, or Firm*—Butzel Long

(57) ABSTRACT

An elevator door restrictor system for preventing an elevator door from being opened unless the elevator car is near a floor landing, utilizing battery backed electronics for sensing the presence of a building landing such that the system will continue to maintain the mechanism in the correct state, either locked or unlocked, even if the elevator car continues to move. Wherein even if the battery backup were to become completely discharged, the mechanism will remain in the last state, either locked or unlocked and prevent the elevator car door from being opened until an authorized person takes the appropriate step to move the car or open the car door.

17 Claims, 2 Drawing Sheets

ELEVATOR CAR DOOR MOVEMENT RESTRICTOR

FIELD OF THE INVENTION

The present invention relates to an elevator door restrictor and more particularly to a system for preventing an elevator door from being opened unless the elevator car is near a floor or landing.

BACKGROUND OF THE INVENTION

When an elevator car is caused to be stalled between floors of a building, the persons trapped in the car should remain in the stalled car until trained assistance arrives to facilitate evacuation. However, oftentimes in such situations, some of the trapped persons may attempt to force the elevator door open in an effort to evacuate. In certain instances the above situation can be extremely dangerous, such as, for example, when the stalled elevator is not at or close to a landing. In such a situation, trapped persons may attempt to jump from the elevator car or climb to a landing. As a result, the trapped persons may fall into the hoistway or elevator shaft, resulting in injury.

Such accidents may be avoided by a door restrictor system that is effective to prevent the opening of the elevator car from inside of the car if the car is at a location away from a landing at a floor of the building.

Restrictor systems of the type referred to above generally include a latching or locking member that is typically not accessible from the inside of the elevator car and must be retracted to render the elevator doors operative. These systems may include sensing means which are capable of producing a signal when the elevator car is at or close to a landing and an electrical actuator which retracts the latching or locking member in response to the produced signal.

The floor sensing means may be an electric switch mounted on the elevator car and actuated by contact with contacting members mounted in the elevator hoistway and more specifically, may be typically mounted on the elevator guide rail and located along the path of travel of the switch. These types of switches tend to deteriorate from wear and are prone to breakage causing continual inspection and frequent replacement.

In recent years door restrictor systems have included photoelectric sensors for detecting the location of an elevator car in respect of the floor landings in a building. An infrared light emitter and appropriate detector are carried by the car and are directed towards the elevator guide rail of the wall of the hoistway. Spaced apart infrared reflecting members on the guide rail or hoistway wall are disposed to reflect infrared radiation from the emitting member when the elevator car is at or close to a landing. Similar systems have employed optical sensors and magnetic sensors to sense the floor landing and lock, or in certain instances, unlock the elevator doors by means of an associated solenoid.

These systems have been deemed unacceptable because they default to a certain position when the electrical power is off and associated back-up battery dies.

Accordingly, some manufacturers have adapted a restrictor system which defaults to a locked state and others default to an unlocked state. Each of these systems results in a state that will be wrong in some instances.

It would be desirable to produce a bi-stable locking system which can remain in either the locked or unlocked state when electrical power is terminated.

SUMMARY OF THE INVENTION

Consistent and consonant with the present invention, a bi-stable locking system which can remain in either the locked or unlocked state when electrical power is terminated, has surprisingly been discovered.

The present invention, in the preferred embodiment utilizes battery-backed electronics for sensing the presence of a building landing. Such a system will continue to maintain the mechanism in the correct state, either locked or unlocked, even if the elevator car continues to move. In a power failure, typically, the elevator car will stop moving within ten (10) seconds. After the expiration of the ten (10) second period, the elevator car should move only if an authorized person is on site to physically lift the brake or open a lowering valve. Even if a battery backup were to become completely discharged, the mechanism will remain in the last state (either locked or unlocked) and prevent the elevator car door from being opened until an authorized person takes the appropriate step to move the car or open the car door.

The door restrictor for preventing opening of an elevator car door by a person inside the car when the car is between unlocking zones at landings along the path of travel of the elevator car comprises:

a primary source of electrical power;

a detecting member in electrical communication with the primary source of electrical power; and an actuated locking device adapted to selectively lock and unlock the elevator car door, an actuation of the locking device controlled by the detecting member, wherein, in the event of a loss of the primary source of electrical power the locking device remains in the selected locked or unlocked position at the time of the loss of the primary source of electrical power.

BRIEF DESCRIPTION OF THE DRAWING

The above, as well as other objects, features, and advantages of the present invention will be understood from the detailed description of the preferred embodiments of the present invention with reference to the accompanying drawings, in which.

DETAILED DESCRIPTION OF THE PREFERRED EMBODIMENT

Figure 1:
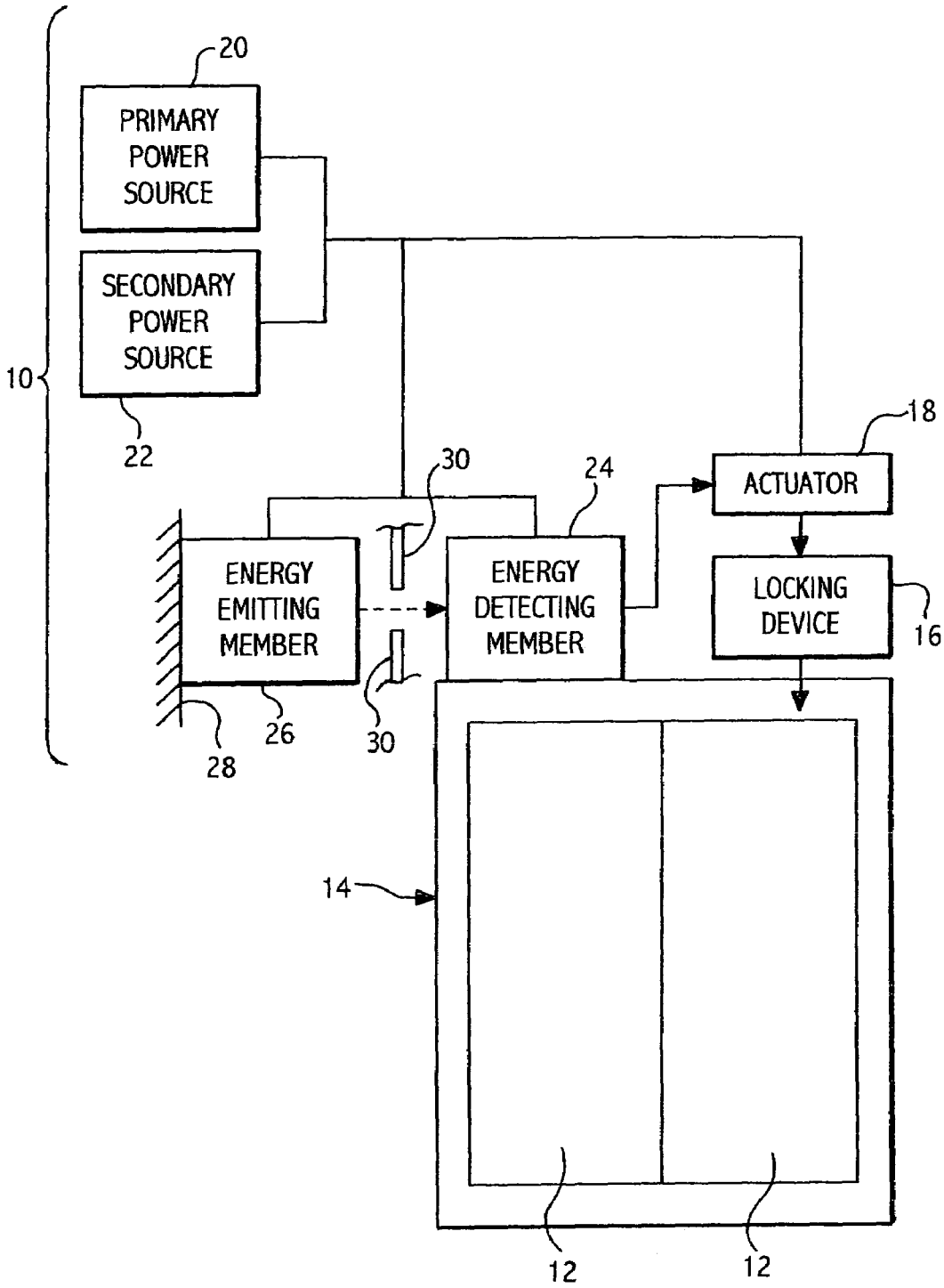
FIG. 1 is a is a schematic diagram showing a door restrictor system incorporating the features of the invention.

Referring now to the drawings, and particularly FIG. 1, there is shown generally at 10 a schematic diagram showing a door restrictor system incorporating the features of the invention. The door restrictor system 10 facilitates selectively locking or unlocking doors 12 of an elevator car 14 to prevent the doors 12 from being opened unless the elevator car 14 is in an unlocking zone near a landing.

The door restrictor system 10 includes a locking device 16 which is typically connected to an actuator 18. The locking device 16 can be any conventional locking device such as a spring loaded pin, an electrical or magnetic device, or other mechanical or electromechanical device, for example. It is understood that any conventional actuator 18 can be used such as a solenoid, for example. The actuator 18 is typically electrically operated, although it is understood that other actuator types can be used such as pneumatic, for example, without departing from the scope and spirit of the invention. In the embodiment shown, the actuator 18 is electrically connected to a primary power source 20 and a secondary power source 22. The secondary power source 22 operates as a backup system to the primary power source 20, and may be a battery backup system or generator backup system, for example. The primary power source is typically the electrical power supplied to the building in which the elevator is housed.

The actuator 18 is controlled by a signal received from an energy detecting member 24. The energy detecting member 24 can be any conventional detector such as a visible light energy detector, infrared detector, or a magnetic detector, for example. The energy detecting member 24 receives and detects energy from an energy emitting member 26. The energy emitting member 26 can be any conventional emitter such as a visible light energy emitter, an infrared emitter, or a magnetic emitter, for example. It is understood that other detecting members can be used such as a mechanical detector, which detects the presence or absence of a structural member, for example, could be used without departing from the scope and spirit of the invention. Such detecting members may or may not require an associated emitting member. In the embodiment shown, the energy detecting member 24 is mounted on the elevator car 14 and the energy emitting member 26 is mounted on a shaft wall 28 of the associated elevator hoistway. It is understood that the energy detecting member 24 can be mounted on the shaft wall 28 and the energy emitting member can be mounted on the elevator car 14 without departing from the scope and spirit of the invention. The energy detecting member 24 and the energy emitting member 26 are electrically connected to the primary power source 20 and the secondary power source 22.

Figure 2:
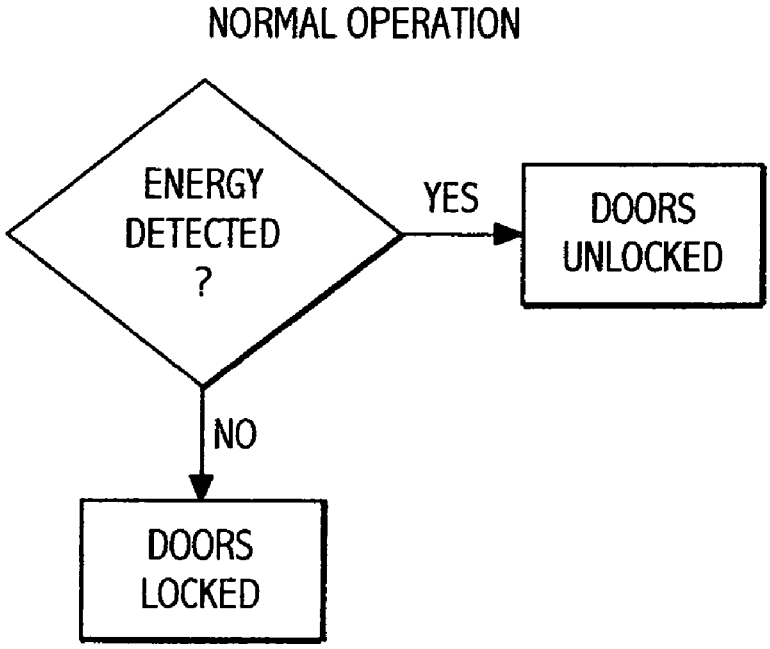
FIG. 2 is a flow diagram showing the normal operation of the energy detecting member of the door restrictor system illustrated in FIG. 1.

In operation, the door restrictor system allows the opening of the elevator car doors by normal automatic operation or by occupants of the elevator car only when an energy path is established between the energy emitting member 26 and the energy detecting member 24. During normal operation, when the elevator car 14 is at a building landing or floor, energy will be emitted by the energy emitting member 26 and will be detected by the energy detecting member 24. Thus, a signal will be sent to the actuator 18 to cause the locking device 16 to be placed in the unlocked position, as schematically illustrated in FIG. 2. Therefore, the doors 12 of the elevator car 14 will be permitted to open, either automatically, or manually. When the elevator car 14 is not at a building landing, the energy is blocked by a blocking device 30. The blocking device 30 can be a vane or protrusion, for example, which blocks the energy emitted by the energy emitting member 26. It is understood that other methods of blocking the energy emitted could be used, such as interrupting power to the energy emitting member 26 to cease emission of the energy. Additionally, it is understood that the actuator 18 could cause the locking device to be placed in the unlocked position in the absence of a signal from the energy detecting member 24, wherein the energy emitted is blocked when the elevator car 14 is at a building landing.

Figure 3:
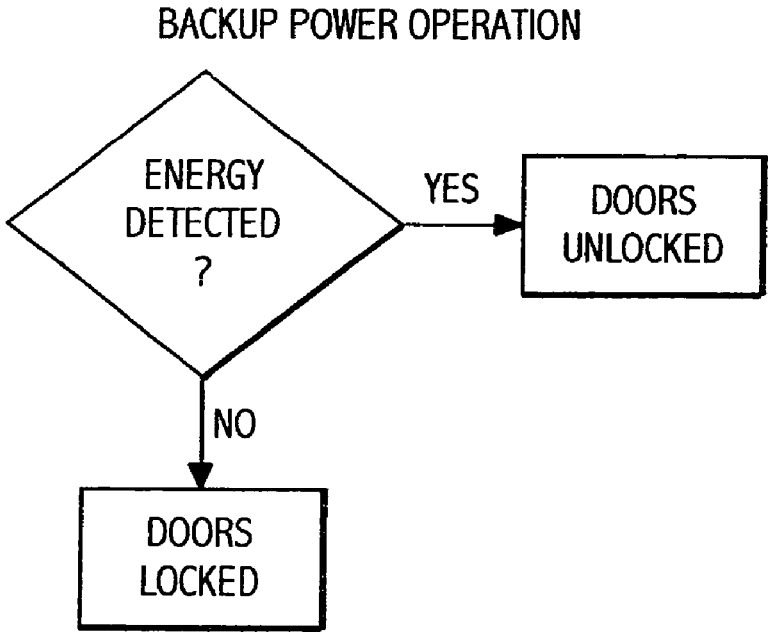
FIG. 3 is a flow diagram showing the backup power operation of the energy detecting member of the door restrictor system illustrated in FIG. 1.

If the primary power source 20 is interrupted or lost, the secondary power source 22 then provides power to the actuator 18, the energy detecting member 24, and the energy emitting member 26. The door restrictor system 10 operates as previously described for normal operation, and as schematically illustrated in FIG. 3. It should be noted that if the primary power source 20 is lost, the elevator car may not be operable, and thus caused to remain in the position when the primary power source 20 was lost. The door restrictor system 10 will, however, continue to operate with power from the secondary power source 22 and maintain the doors 12 of the elevator car 14 in a locked or unlocked condition as dictated by the energy detecting member 24 and the actuator 18.

It is possible that the secondary power source 22 will be lost or interrupted. If this occurs, and the signal from the energy emitting member 24 is lost, the actuator 18 will cause or permit the locking device 16 to remain in the same position as when power from the secondary power source was lost. Thus, in the event the locking device 16 was in the locked position since the elevator car 14 was not at a building landing, the locking device 16 will remain in the locked position. Conversely, in the event the locking device 16 was in the unlocked position since the elevator car was located at a building landing, the locking device 16 will remain in the unlocked position. Therefore, as a safety device, the locking device 16 will remain in the desired position, either locked or unlocked, until manually altered by an authorized attendant. So, for example, in the event the elevator car 14 is caused to stop due to a loss of the primary power source 20 at a point not at a floor landing, the secondary power source 22 will be activated and the locking device 16 will be maintained in the locked position. Should the secondary power source be lost, the locking device 16 will maintain the present position and the doors 12 of the elevator car 14 will remain locked until manually unlocked by the authorized attendant. However, in the event the elevator car 14 is caused to stop due to a loss of the primary power source 20 at a point at a floor landing, the secondary power source 22 will be activated and the locking device 16 will be maintained in the unlocked position. Should the secondary power source be lost, the locking device 16 will maintain the present position and the doors 12 of the elevator car 14 will remain unlocked. The following summarizes the various conditions under which the door restrictor system 10 may operate:

1. Normal operation (operating under the primary power source 20)—energy detected as illustrated in FIG. 2.

2. Loss of the primary power source 20 and operating under the secondary power source 22—energy detected as illustrated in FIG. 3.

3. Loss of the primary power source 20 and loss of the secondary power source 22—the locking device 16 remains in last position prior to loss of power as determined by the energy detecting member 24 and the actuator 18.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A bi-stable restrictor for an elevator car door comprising:

a primary source of electrical power;

a detecting member in electrical communication with said primary source of electrical power; and a locking device connected to said detecting member and adapted to selectively move between a locked position to lock an elevator car door and an unlocked position to unlock the elevator car door in response to actuation controlled by said detecting member, wherein, in the event of a loss of said primary source of electrical power said locking device remains in the selected locked or unlocked position at the time of the loss of said primary source of electrical power.

2. The bi-stable restrictor according to claim 1, further comprising a secondary source of electrical power provided as a backup for said primary source of electrical power, wherein said secondary source of electrical power is connected to and provides power to said detecting member in the event of the loss of said primary source of electrical power.

3. The bi-stable restrictor according to claim 2, wherein in the event of the loss of said primary source of electrical power, and a loss of said secondary source of electrical power, said locking device remains in the selected locked or unlocked position at the time of the loss of said secondary source of electrical power.

4. The bi-stable restrictor according to claim 1, wherein said locking device is electrically actuated.

5. The bi-stable restrictor according to claim 4, wherein said locking device is in electrical communication with said primary source of electrical power.

6. The bi-stable restrictor according to claim 1, further comprising an emitting member, wherein said detecting member receives a signal from said emitting member and actuates said locking device in response to such signal.

7. The bi-stable restrictor according to claim 6, wherein said detecting member is an energy detecting member, said emitting member is an energy emitting member, and the signal is energy emitted from said emitting member.

8. The bi-stable restrictor according to claim 7, wherein said detecting member causes said locking device to be actuated to the locked position when detecting the energy emitted by said energy emitting member.

9. The bi-stable restrictor according to claim 1, further comprising a solenoid operably connected to said locking member and electrically connected to said primary source of electrical power, wherein said solenoid selectively causes said locking device to move between the locked and unlocked positions, said solenoid being connected to and controlled by said detecting member.

10. A bi-stable restrictor for an elevator car door comprising:

a primary source of electrical power;

a secondary source of electrical power provided as a backup for said primary source of electrical power;

a detecting member in electrical communication with said primary source of electrical power and said secondary source of electrical power; and a locking device connected to said detecting member and adapted to selectively switch said locking device between a locked position to lock an elevator car door and an unlocked position to unlock the elevator car door in response to actuation controlled by said detecting member, wherein, in the event of a loss of said primary source of electrical power and said secondary source of electrical power said locking device remains in the selected locked or unlocked position at the time of the loss of said secondary source of electrical power.

11. The bi-stable restrictor according to claim 10, wherein said locking device is electrically actuated.

12. The bi-stable restrictor according to claim 11, wherein said locking device is in electrical communication with said primary source of electrical power and said secondary source of electrical power.

13. The bi-stable restrictor according to claim 10, further comprising an emitting member, wherein said detecting member receives a signal from said emitting member and actuates said locking device in response to such signal.

14. The bi-stable restrictor according to claim 13, wherein said detecting member is an energy detecting member, said emitting member is an energy emitting member, and the signal is energy emitted from said emitting member.

15. The bi-stable restrictor according to claim 14, wherein said detecting member causes said locking device to be actuated to the looked position when detecting the energy emitted by said energy emitting member.

16. The bi-stable restrictor according to claim 10, further comprising a solenoid operably connected to said locking member and electrically connected to said primary source of electrical power and said secondary source of electrical power, wherein said solenoid selectively causes said locking device switch between the locked and unlocked positions, said solenoid being controlled by said detecting member.

17. A method of controlling an opening of elevator car doom, comprising the steps of:

a) providing a detecting member elevator connected to a primary source of electrical power and producing a signal from the detecting member responsive to a position of an;

b) selectively controlling a locking device for elevator car doors with the signal produced by the detecting member;

c) providing a secondary source of electrical power, and operating the secondary source of electrical power as a backup to the priniary source of electrical power to supply electrical power to the detecting member upon loss of the primary source of power, and d) causing the locking device to remain in the selected position upon a loss of the secondary source of electrical power.

* * * * *